US005540204A

United States Patent [19]

Schnaibel et al.

[11] Patent Number: 5,540,204

[45] Date of Patent: Jul. 30, 1996

[54] METHOD FOR REDUCING A TORQUE OUTPUT OF AN INTERNAL COMBUSTION ENGINE

[75] Inventors: Eberhard Schnaibel, Hemmingen; Helmut Denz, Stuttgart; Hong Zhang, Schwieberdingen; Klaus Boettcher, Oberriexingen, all of Germany

[73] Assignee: Robert Bosch GmbH, Stuttgart, Germany

[21] Appl. No.: 337,923

[22] Filed: Nov. 10, 1994

[30] Foreign Application Priority Data

Dec. 7, 1993 [DE] Germany ..... 43 41 584.9

[51] Int. Cl.[6] ..... F02D 7/00

[52] U.S. Cl. ..... 123/481

[58] Field of Search ..... 123/481; 364/426.02, 364/426.03

[56] References Cited

U.S. PATENT DOCUMENTS

| | | | |
|---|---|---|---|
| 4,470,390 | 9/1984 | Omori et al. | 123/481 |
| 4,550,704 | 11/1985 | Barho et al. | 123/481 |
| 4,860,847 | 8/1989 | Shiraishi et al. | 123/481 |
| 4,860,849 | 8/1989 | Andersson et al. | 123/481 |
| 5,025,881 | 6/1991 | Poirier et al. | 123/481 |
| 5,038,883 | 8/1991 | Kushi et al. | 180/197 |
| 5,154,151 | 10/1992 | Bradshaw et al. | 123/481 |
| 5,190,013 | 3/1993 | Dozier | 123/481 |
| 5,287,279 | 2/1994 | Anan | 364/426.02 |
| 5,291,408 | 3/1994 | Thatcher | 364/426.03 |
| 5,425,335 | 6/1995 | Miyamoto et al. | 123/481 |
| 5,425,340 | 6/1995 | Petitbon et al. | 123/481 |

OTHER PUBLICATIONS

B. Böning et al., "Traction Control (ASR) Using Fuel–Injection Suppression–A Cost Effective Method of Engine-Torque Control", SAE Paper No. 920641, Feb. 1992, pp. 35–42.

*Primary Examiner*—Raymond A. Nelli
*Attorney, Agent, or Firm*—Kenyon & Kenyon

[57] ABSTRACT

A control system and method for an internal-combustion engine with which the torque output of the internal-combustion engine can be reduced by suppressing the injection of fuel in individual cylinders in accordance with specifiable suppression patterns or by shifting the ignition firing point or the ignition angle. The suppression pattern is selected in dependence upon the desired torque reduction. The suppression of cylinders is allowed, however, only when in the case of the selected suppression pattern the number of cylinders to be suppressed per working cycle lies above a threshold value. The threshold value is selected in dependence upon the operating state of the internal-combustion engine, in particular on at least one of the following operating parameters: temperature of the internal-combustion engine, exhaust gas temperature, catalytic-converter temperature, load, rotational frequency, and a variable indicating whether a warm-up function of the internal-combustion engine has been activated.

11 Claims, 4 Drawing Sheets

| | | |
|---|---|---|
| 0 | * * * * | * * * * |
| 0.5 | _ * * * | * * * * |
| 1 | _ * * * | _ * * * |
| 1.5 | _ * _ * | _ * * * |
| 2 | _ * _ * | _ * _ * |
| 2.5 | _ _ _ * | _ * _ * |
| 3 | _ _ _ * | _ _ _ * |
| 3.5 | _ _ _ _ | _ _ _ * |
| 4 | _ _ _ _ | _ _ _ _ |
| | 1 3 4 2 | 1 3 4 2 |

FIG. 2

METHOD FOR REDUCING A TORQUE OUTPUT OF AN INTERNAL COMBUSTION ENGINE

FIELD OF THE INVENTION

The present invention relates to a control system for an internal-combustion engine. More specifically, the present invention relates to a control system for controlling the torque output of an internal-combustion engine.

BACKGROUND OF THE INVENTION

A traction control system, referred to as the ASR system, is described in SAE paper No. 92 06 41, entitled "Traction Control (ASR) Using Fuel-Injection Suppression - A Cost Effective Method of Engine-Torque Control." The ASR system serves to counteract any free spinning of the wheels on the vehicle, thus allowing optimal transfer of force to the road surface, and, among other things, optimal acceleration of the vehicle. The torque of the internal-combustion engine can be reduced through a cylinder-selective interruption of fuel injection in accordance with predetermined suppression patterns. Furthermore, the torque can be reduced by retarding the ignition firing point.

However, both the suppression of cylinders and the shifting of the ignition firing point can influence the temperature of a catalytic converter mounted in the exhaust system of the internal-combustion engine. The aforementioned reference, however, states that an unacceptably high catalytic-converter temperature did not occur in test cycles that were run using the described system.

SUMMARY OF THE INVENTION

An object of the present invention is to guarantee that the catalytic converter of an internal-combustion engine is reliably protected from excess temperature when torque interventions are carried out on the engine.

In the case of the control system and method of the present invention, the torque output of the internal-combustion engine can be reduced by suppressing the fuel injection in at least one cylinder or by retarding the ignition angle or the ignition firing point. The fuel injection is suppressed in accordance with specifiable suppression patterns, which are characterized by the number of suppressions per crank-angle interval. A desired suppression pattern is specified in dependence upon the extent to which the torque is to be reduced.

Furthermore, in order to prevent the application of a suppression pattern which would lead to an unacceptably high catalytic-converter temperature or to unnecessarily high exhaust emissions, a threshold value is specified for the number of suppressions per crank-angle interval in dependence upon at least one operating parameter. When, given the desired suppression pattern, the number of suppressions per crank-angle interval exceeds the threshold value, fuel injection is suppressed in accordance with the desired suppression pattern. If, on the other hand, the threshold value is not exceeded, no suppression of the fuel injection is carried out. In this case, the torque is reduced by retarding the ignition angle or the ignition firing point. Thus, the control system of the present invention has the advantage of making available the maximum feasible suppression pattern for each operating state, without running the risk of damage to the catalytic converter.

Especially advantageous operating parameters to be used in determining the threshold value for the number of suppressions per crank-angle interval include the exhaust temperature or the catalytic-converter temperature that is determined on the basis of a model or is measured, the temperature of the internal-combustion engine, and a variable which indicates whether the internal-combustion engine is in a warm-up phase. Furthermore, the load or the rotational frequency can also be used as the operating parameter.

For as long as the exhaust gas or the catalytic-converter temperature lies below a specifiable value, the threshold value is high for the number of suppressions, so that only suppression patterns having a high number of suppressions are permitted. When the exhaust gas or the catalytic-converter temperature exceeds the specifiable value, suppression patterns having a low number of suppressions are also permitted, i.e. the threshold value is low for the number of suppressions. In this manner, the exhaust gas and the catalytic-converter temperature can be reduced. Overall, therefore, one attains the advantage that in operating modes in which the exhaust gas and the catalytic-converter temperature are not critical, the torque is reduced mainly by adjusting the ignition angle, so that loss of driving comfort and poorer exhaust gas values can be largely avoided.

A further advantage of the present invention is that the air/fuel mixture can be enriched when the ignition firing point is retarded, so that the exhaust gas temperature, or catalytic-converter temperature, does not exceed the maximum permissible value.

BRIEF DESCRIPTION OF THE DRAWINGS

FIG. 2 shows a table of suppression patterns for the fuel injection of a four-cylinder internal-combustion engine.

DETAILED DESCRIPTION OF THE DRAWINGS

Figure 1:
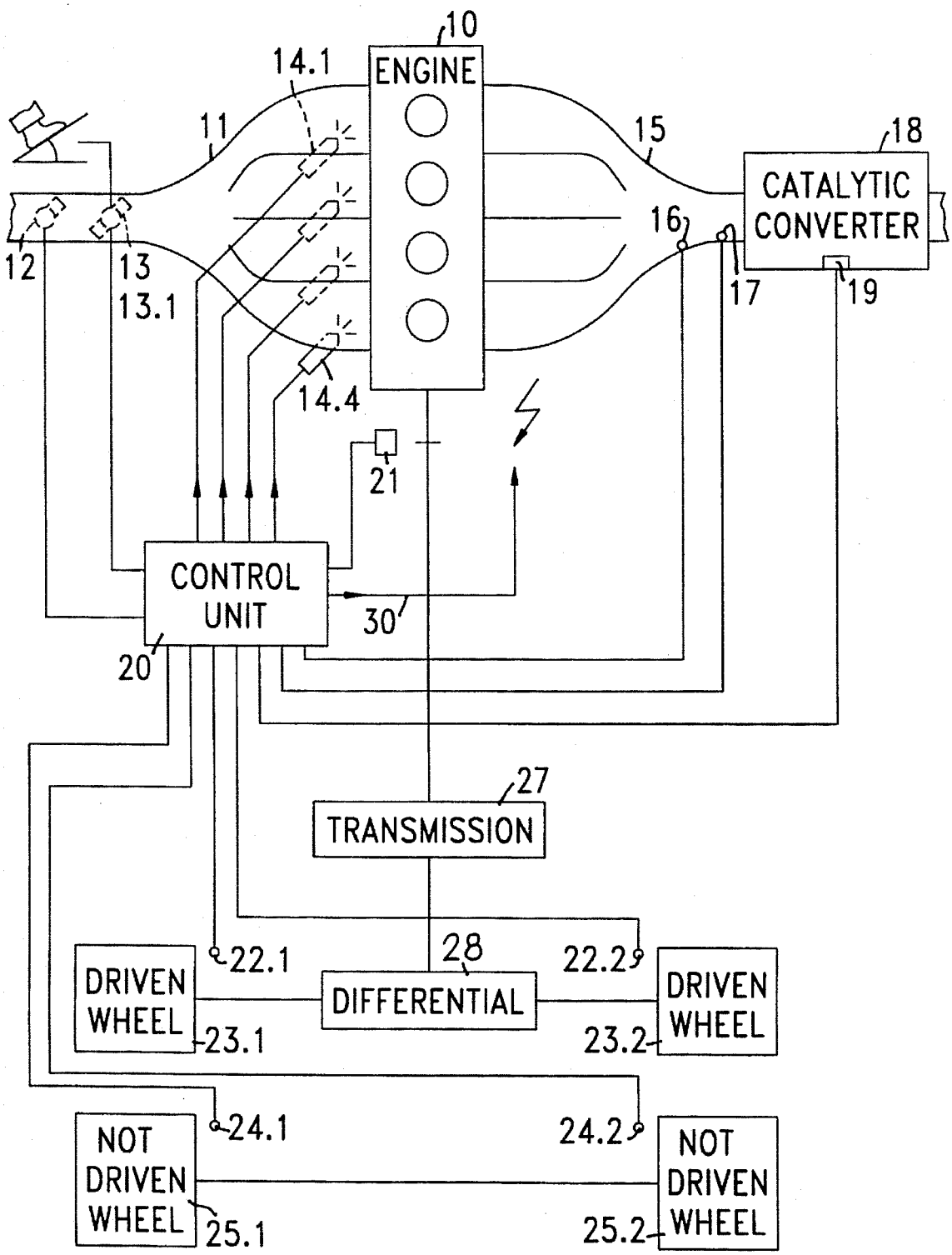
FIG. 1 is a schematic representation of an internal combustion engine and of components that are relevant to the description of the present invention.

FIG. 1 depicts an internal-combustion engine 10 in whose intake section 11 there are arranged, successively in the direction of flow, an air-flow or air-mass flow sensor 12, a throttle valve 13, and a set of fuel injection valves 14.1–14.4, with one valve per cylinder. The engine 10 also has an exhaust duct 15 in which there are arranged, successively in the direction of flow, an exhaust gas analyzer probe 16, an exhaust gas temperature sensor 17, and a catalytic converter 18 having a catalytic-converter temperature sensor 19.

A control unit 20, in accordance with the present invention, includes inputs for signals from the air-flow or air-mass flow sensor 12, from a reference mark sensor 13.1 connected to the throttle valve 13, from an RPM sensor 21 for determining the rotational speed of the internal-combustion engine 10, from the exhaust gas sensor 16 for sensing the composition of the exhaust gas, from the exhaust gas temperature sensor 17, from the catalytic-converter temperature sensor 19, and from four wheel-speed sensors 22.1, 22.2, 24.1 and 24.2. The wheel-speed sensors 22.1 and 22.2 detect the speed of the driven wheels 23.1 and 23.2. The wheel-speed sensors 24.1 and 24.2 detect the speed of the wheels 25.1 and 25.2 that are not driven. The drive torque of the driven wheels 23.1 and 23.2 is provided by the internal-combustion engine 10 via a transmission 27 and a differential 28.

The control unit 20 triggers the injection valves 14.1 through 14.4. Furthermore, as schematically represented by a line 30, the control unit 20 triggers the engine's spark plugs (not shown), or rather an ignition control unit connected in incoming circuit.

From the individual operating parameters of the internal-combustion engine 10, the control unit 20 determines signals for triggering the injection valves 14.1 through 14.4 and signals for triggering the spark plugs (not shown). Operating states are considered in the following, in which a reduction in the torque output by the internal-combustion engine 10 is required, in particular. This is the case, for example, when a reduction of the drive torque is necessary within the framework of a traction control.

If the control unit 20 determines through evaluation of the signals from the wheel-speed sensors 22.1, 22.2, 24.1 and 24.2 that the tire slippage is too great, it then intervenes by means of the fuel injection and/or ignition to reduce the drive torque. Intervention by way of the fuel injection entails suppressing the fuel metering for individual cylinders, i.e., the injection valves of the cylinders in question remain closed. The suppression follows as a graduated suppression in accordance with specifiable suppression patterns, so that a specifiable number of cylinders are suppressed depending on the extent of the drive torque reduction that is desired.

FIG. 2 illustrates by way of example nine different fuel injection suppression patterns in the case of a four-cylinder internal-combustion engine, with one suppression pattern depicted in each line. Each suppression pattern indicates which cylinders are being supplied with fuel during a working cycle, as indicated by the symbol "*", and which cylinders are being suppressed, as indicated by the symbol "-". The cylinders are depicted from left to right in sequence of ignition and are numbered 1 through 4 to correspond to their positions on the internal-combustion engine. To represent the suppression patterns used in the exemplary embodiment, a span of two working cycles suffices, i.e. four crankshaft revolutions. After that, the suppression patterns repeat themselves.

In the case of the uppermost suppression pattern of FIG. 2, all cylinders are supplied with fuel, both in the first as well as in the second working cycle; i.e., no suppression takes place. In the case of the second suppression pattern from the top, cylinder 1 is suppressed in the first working cycle and supplied again with fuel in the second working cycle. All other cylinders are supplied in both working cycles with fuel. In the third suppression pattern, cylinder 1 is suppressed in both working cycles, while cylinders 2, 3 and 4 are supplied with fuel in both working cycles.

In the same way, in each of the following suppression patterns, one cylinder is additionally suppressed, i.e., arithmetically one half of a cylinder per working cycle, until all cylinders are suppressed in both working cycles, as is the case in the bottom suppression' pattern. The number of suppressions per working cycle is indicated to the left of each suppression pattern. The number of suppressions per working cycle increases from the uppermost to the bottom suppression pattern in increments of 0.5, from a value of 0 to a value of 4. In other words, in the case of the uppermost suppression pattern, injection is not suppressed for any of the cylinders, and, in the case of the bottom suppression pattern, injection is suppressed for all cylinders. The more cylinders that are suppressed, the greater the extent to which the torque output of the internal-combustion engine 10 and, thus, the drive torque of the motor vehicle are reduced. Consequently, an appropriate suppression pattern can be selected in dependence upon the required reduction of the drive torque.

As mentioned above, the drive torque can also be reduced by retarding the ignition firing point. Besides reducing the drive torque, however, shifting the ignition firing point as well as suppressing individual cylinders can lead to an unwanted increase in the exhaust gas and/or the catalytic-converter temperature.

A late ignition firing point leads to a late combustion of the air/fuel mixture, so that very hot exhaust gases are emitted into the exhaust duct; i.e., the exhaust gas and, thus also the catalytic-converter temperatures are increased.

Figure 4:
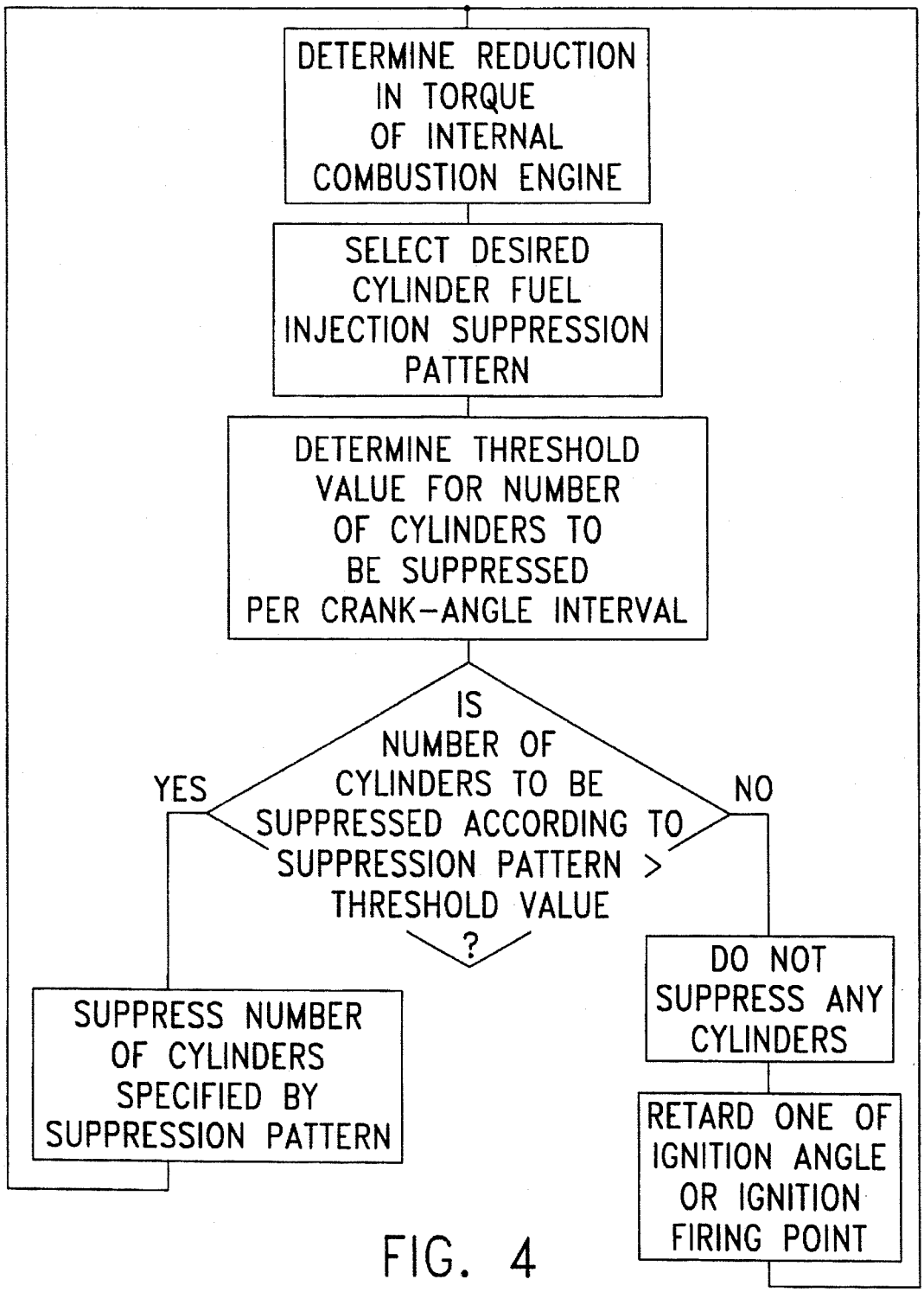
FIG. 4 illustrates an exemplary method for reducing the torque output of an internal combustion engine according to the present invention.

When individual cylinders are suppressed, unburned fuel and fresh air can reach the catalytic converter 18 and be converted there exothermically, leading to an increase in the catalytic-converter temperature. In particular, during a warm-up phase of the internal-combustion engine 10, in which the air/fuel mixture is enriched, a suppression pattern with a very small number of suppressed cylinders could lead to an unacceptable increase in the catalytic-converter temperature. Moreover, the suppression of cylinders leads generally to a higher emission of exhaust gas. This situation is prevented by the system of the present invention. FIG. 4 illustrates an exemplary method for reducing the torque output of an internal combustion engine according to the present invention.

Because the influence of cylinder fuel suppression on the catalytic-converter temperature depends on the number of suppressed cylinders, a threshold value S is specified, in accordance with the present invention, for the number of suppressions per working cycle or, generally, per crank-angle interval. The suppression of cylinder fuel injection is permitted only when the number of cylinders suppressed per working cycle for the suppression pattern determined to provide the required torque reduction exceeds the threshold value S. Below the threshold value S, only ignition intervention is allowed. In the case of the ignition intervention, the mixture can be enriched starting from an ignition-angle or exhaust gas temperature threshold, to ensure that the exhaust gas and the catalytic-converter temperatures do not exceed the permissible values.

The threshold value S is specified in dependence upon at least one operating parameter in order to take into account that the influence of the cylinder suppression on the catalytic-converter temperature can vary depending on the operating state of the internal-combustion engine 10, and that a temperature increase of varying magnitude is permissible, depending on the catalytic-converter temperature. Important operating parameters in this connection are the temperature TBKM of the internal-combustion engine 10, the exhaust gas or catalytic-converter temperature determined from a model, the operating state of a warm-up function (i.e., whether the warm-up function is active or not), the load, and the rotational frequency. The threshold value S can depend on one or more of these operating parameters.

In the case of a high exhaust gas or catalytic-converter temperature, the threshold value S will, for example, be set low, so that only those suppression patterns having a very low number of suppressions are ruled out, since such suppression patterns could cause the maximum permissible catalytic-converter temperature to be exceeded. Suppression patterns having an average or a large number of suppressed cylinders lead to a cooling of the catalytic converter 18 and are therefore permitted.

In the case of a low exhaust gas or catalytic-converter temperature, a high threshold value S is specified, so that as a rule, the torque is reduced by adjusting the ignition angle, thus making it possible to substantially avoid an increase in the exhaust gas emissions.

In the case in which an engine warm-up function has been activated, the threshold value S will likewise be set high, since during warm-up, a suppression of fewer cylinders leads to a marked increase in the catalytic-converter temperature due to the richer air/fuel mixture. As a rule, the warm-up function is activated when the temperature TBKM of the internal-combustion engine 10 is low. For that reason, given a low engine temperature TBKM, the threshold value S is likewise set high. The relation between the threshold value S and the temperature TBKM of the internal-combustion engine 10 is shown in FIG. 3.

Figure 3:
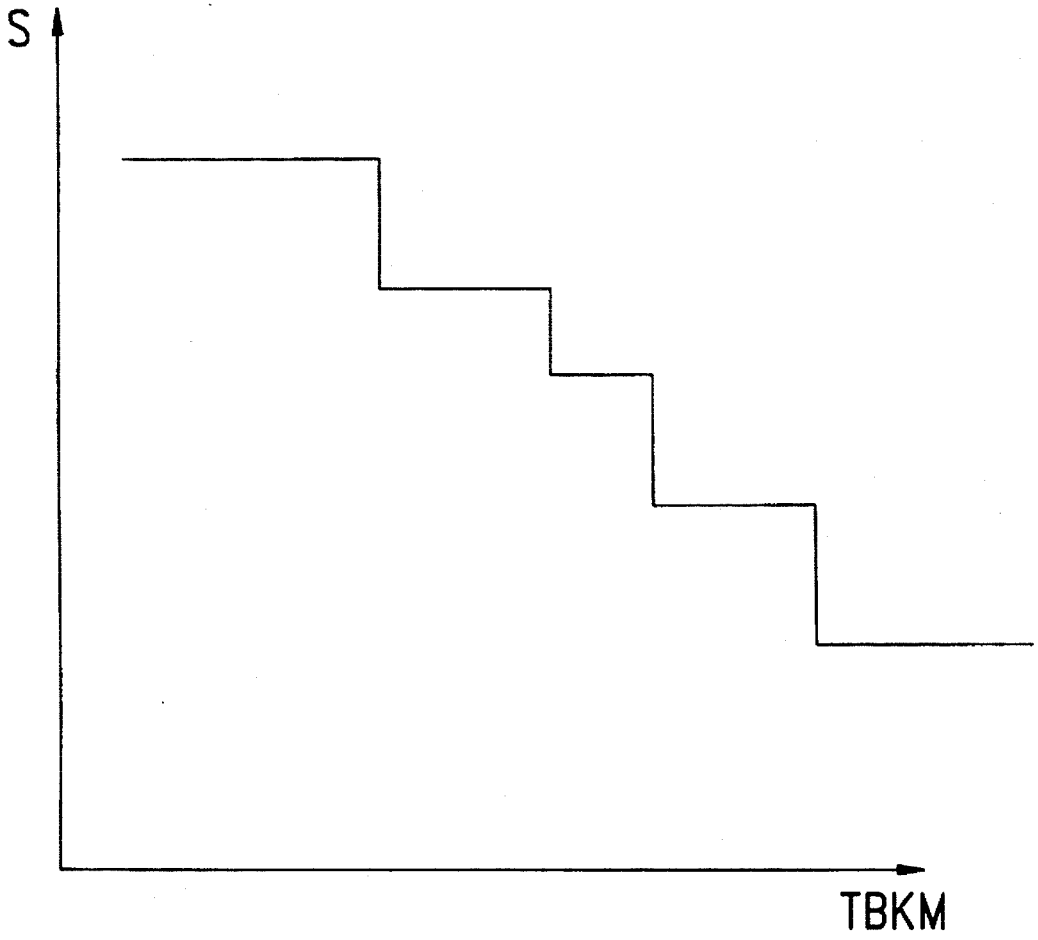
FIG. 3 shows a graph of the threshold value S for the number of suppressions per crank-angle interval as a function of the temperature TBKM of the internal-combustion engine.

In FIG. 3, the threshold value S is depicted for the number of cylinders suppressed per working cycle in dependence upon the temperature TBKM of the internal-combustion engine 10. Cylinder fuel suppression patterns in which the number of cylinders suppressed per working cycle exceeds the threshold S, i.e., lies above the curve of FIG. 3, are allowed, whereas suppression patterns in which the number of cylinders suppressed per working cycle does not exceed the threshold S are not allowed. Below the curve, however, an ignition intervention is allowed. Given a very low temperature TBKM of the internal-combustion engine 10, because of the high threshold value S, a comparatively heavy reduction in the torque must be carried out solely by means of the ignition intervention. Consequently, the ignition firing point must be retarded considerably, which would lead, per se, to a marked increase in the exhaust gas temperature. Given a cold internal-combustion engine 10, however, this is not very problematic, since the exhaust gas temperature is very low anyway because the cylinder walls are still cold.

The threshold value S for the cylinder suppression is specified so as not to permit, as a general principle, a suppression of half of a cylinder per working cycle, in other words one cylinder for every two working cycles, as this would lead to a very marked increase in the catalytic-converter temperature.

What is claimed is:

1. A method for reducing a torque output of an internal-combustion engine, comprising the steps of:

selecting a desired cylinder fuel injection suppression pattern as a function of a desired reduction in the torque output of the engine, wherein the desired cylinder fuel injection suppression pattern causes suppression of fuel injection for a predetermined number of cylinders per crank-angle interval;

determining a threshold value for a threshold number of cylinders per crank-angle interval whose fuel injection is to be suppressed, the threshold value being determined as a function of at least one operating parameter of the internal combustion engine; and suppressing fuel injection in accordance with the desired fuel injection suppression pattern only when the predetermined number of cylinders per crank-angle interval whose fuel injection is to be suppressed exceeds the threshold value.

2. The method according to claim 1, further comprising the step of, when the predetermined number of cylinders per crank-angle interval whose fuel injection is to be suppressed does not exceed the threshold value, controlling an ignition timing of the engine.

3. The method according to claim 2, wherein the step of controlling the ignition timing of the engine includes one of retarding an ignition angle and retarding an ignition firing point.

4. The method according to claim 3, wherein retarding the ignition firing point causes an air/fuel mixture drawn in by the engine to be enriched.

5. The method according to claim 1, wherein the threshold value is determined as a function of at least one parameter selected from the group of engine operating parameters consisting of an exhaust gas temperature, a catalytic-converter temperature, a temperature of the internal-combustion engine, a variable which indicates whether the internal-combustion engine is in a warm-up phase, a load, and a rotational frequency of the internal-combustion engine.

6. The method according to claim 1, wherein the threshold value is determined to be a first value when a temperature of the internal-combustion engine is at a first temperature value and wherein the threshold value is determined to be a second value when the temperature of the internal-combustion engine is at a second temperature value, wherein the first value is greater than the second value, and the first temperature value is less than the second temperature value.

7. The method according to claim 1, wherein the threshold value is determined to be a first value when a temperature at an exhaust of the internal-combustion engine is at a first temperature value and wherein the threshold value is determined to be a second value when the temperature of the exhaust is at a second temperature value, wherein the first value is greater than the second value and the first temperature value is less than the second temperature value.

8. The method according to claim 1, wherein the threshold value is determined to be greater than one suppression per four crankshaft revolutions.

9. The method according to claim 1, further comprising the step of performing a function selected from a group of automotive functions consisting of controlling traction, limiting a rotational frequency of the internal-combustion engine, limiting a vehicle velocity, protecting a transmission, and controlling a transmission.

10. The method according to claim 1, wherein the threshold value is determined to be a first value when a temperature at a catalytic-converter of the internal-combustion engine is at a first temperature value and wherein the threshold value is determined to be a second value when the temperature of the catalytic-converter is at a second temperature value, wherein the first value is greater than the second value and the first temperature value is less than the second temperature value.

11. A method for reducing a torque output of an internal-combustion engine, comprising the steps of:

selecting a desired cylinder fuel injection suppression pattern as a function of a desired reduction in the torque output of the engine, wherein the desired cylinder fuel injection suppression pattern causes suppression of fuel injection for a predetermined number of cylinders per crank-angle interval;

determining a threshold value for a threshold number of cylinders per crank-angle interval whose fuel injection is to be suppressed, the threshold value being determined as a function of at least one operating parameter of the internal combustion engine; and suppressing fuel injection in accordance with the desired fuel injection suppression pattern only when the predetermined number of cylinders per crank-angle interval whose fuel injection is to be suppressed exceeds the threshold value; and when the predetermined number of cylinders per crank-angle interval whose fuel injection is to be suppressed is less than the threshold value, retarding one of an ignition angle of the engine and an ignition firing point of the engine.

* * * * *